US005348152A

United States Patent [19]

Kiyoshi et al.

[11] Patent Number: 5,348,152

[45] Date of Patent: Sep. 20, 1994

[54] SPARE BLADE STORAGE CASE FOR BARBER'S RAZOR

[75] Inventors: Ido Kiyoshi; Fujii Hideo, both of Seki, Japan

[73] Assignee: Feather Safety Razor Co., Ltd., Osaka, Japan

[21] Appl. No.: 17,737

[22] Filed: Feb. 16, 1993

[30] Foreign Application Priority Data

Feb. 18, 1992 [JP] Japan ..... 4-061045

[51] Int. Cl.[5] ..... A45C 11/26

[52] U.S. Cl. ..... 206/354; 206/480

[58] Field of Search ..... 206/352, 354, 356, 355, 206/359, 477, 480, 565; 211/70.7

[56] References Cited

U.S. PATENT DOCUMENTS

| | | | |
|---|---|---|---|
| 1,813,686 | 7/1931 | Stetson | 206/354 X |
| 3,606,006 | 9/1971 | Raybois | 206/534 |
| 3,643,794 | 2/1972 | Bragiretz | 206/354 |
| 3,797,657 | 3/1974 | Petrillo | 206/356 |
| 4,173,285 | 11/1979 | Kiraly et al. | 206/356 |
| 4,341,305 | 7/1982 | Shultz | 206/356 |
| 4,685,564 | 8/1987 | Hills et al. | 206/354 |

FOREIGN PATENT DOCUMENTS

| | | | |
|---|---|---|---|
| 278622 | 10/1927 | United Kingdom | 206/354 |

*Primary Examiner*—Bryon P. Gehman
*Attorney, Agent, or Firm*—Ladas & Parry

[57] ABSTRACT

A spare blade storage case for barbers' razors of the type which hold replaceable blades. The spare blades are held laterally in the case which allows the blades to be taken out from the case by a direct upwardly motion. There are provided storage spaces for individual spare blades, each of the storage spaces being defined by a pair of sidewalls which rise from a bottom of the case and are yieldable away from the spare blade as this spare blade is inserted into this space. The sidewalls are provided on their inner surfaces with projections engageable with upper sides of ridges formed on both sides of each spare blade. One end wall of the case is opened so as to expose at least one end portion of the spare blades extending above the ridges thereof.

2 Claims, 6 Drawing Sheets

SPARE BLADE STORAGE CASE FOR BARBER'S RAZOR

FIELD OF THE INVENTION

This invention relates to an improvement of a spare blade case for a barber's razor.

BACKGROUND OF THE INVENTION

Typically, such spare blade case is conventionally arranged (as disclosed, for example, by Japanese Patent Application Disclosure Gazette No. 1985-63082) so that a razor blade proper is covered with a backing strip made of plastic material except for an exposed shaving edge, and this backing strip is provided, at longitudinally opposite ends thereof, with recesses adapted to be engaged with corresponding inward projections provided at longitudinally opposite ends of each spare blade receiving space of the case, as the spare blade is stored in the space.

With the spare blade storage case of the prior art arrangement mentioned above, flanges longitudinally formed on opposite inner sidewalls of a blade holder are engaged in corresponding guide grooves longitudinally extending in opposite outer sidewalls of the plastic backing strip for the blade. Then, the rear end of the blade holder is lifted up, and thereby the projections are disengaged from the recesses so that the spare blade may be picked up. However, such arrangement of prior art requires a two-step operation to take the individual spare blade out from the case, i.e., the first step of coupling the blade holder to the spare blade, and the second step of forcibly disengaged the case projections from the corresponding recesses of the backing strip. Additionally, the spare blade is obliquely oriented within the case as the rear end of the blade holder is lifted up in order to take the spare blade out from the case, and consequently the ends of the spare blade would bear against the case walls without taking any appropriate evasive measures. To avoid such inconvenience, the lower corners at the longitudinally opposite ends of the spare blade (and, therefore, of the plastic backing strip) must be obliquely cut away. Thus, it is impossible to form the spare blade in a true rectangular shape, and the blade holder thus becomes excessively longer than the shaving edge of the spare blade.

SUMMARY OF THE INVENTION

In view of the above-mentioned problem, the invention resides in a case for storage of spare blades 2 each being of a thin, narrow and long configuration and provided on both side surfaces thereof with longitudinally extending ridges 1, characterized by sidewalls 3, extending upwardly from a bottom 4 of the case laterally define a space for storage of each spare blade 2, so that these sidewalls 3 are yieldable away from the spare blade 2 as the spare blade 2 is inserted into the defined space. The sidewalls 3 are provided on their inner surfaces with projections 5 adapted to be engaged with upper sides of the respective ridges 1 of the spare blade 2 once this spare blade 2 has been stored in the defined space. One end wall 6 of the case is partially opened so as to expose at least the portion of the spare blade 2 thus stored in the case extending above the ridges 1 at one end.

BRIEF DESCRIPTION OF THE DRAWINGS

Details of the invention will be readily understood from the following description of presently preferred embodiments made with reference to the attached drawings, in which.

DETAILED DESCRIPTION OF THE PREFERRED EMBODIMENTS

Figure 8:
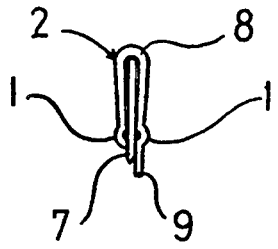
FIG. 8 is an end view of a spare blade.

A spare blade 2 comprises a metallic blade 7 and a metallic backing strip 8 fixedly mounted on the blade 7 (cf FIG. 8). One lower edge of the backing strip 8 is formed with a plurality of comb teeth 9 which extend beyond the shaving edge of the spare blade. The backing strip 8 is press-formed on both sides with longitudinally extending ridges 1.

Figure 1:
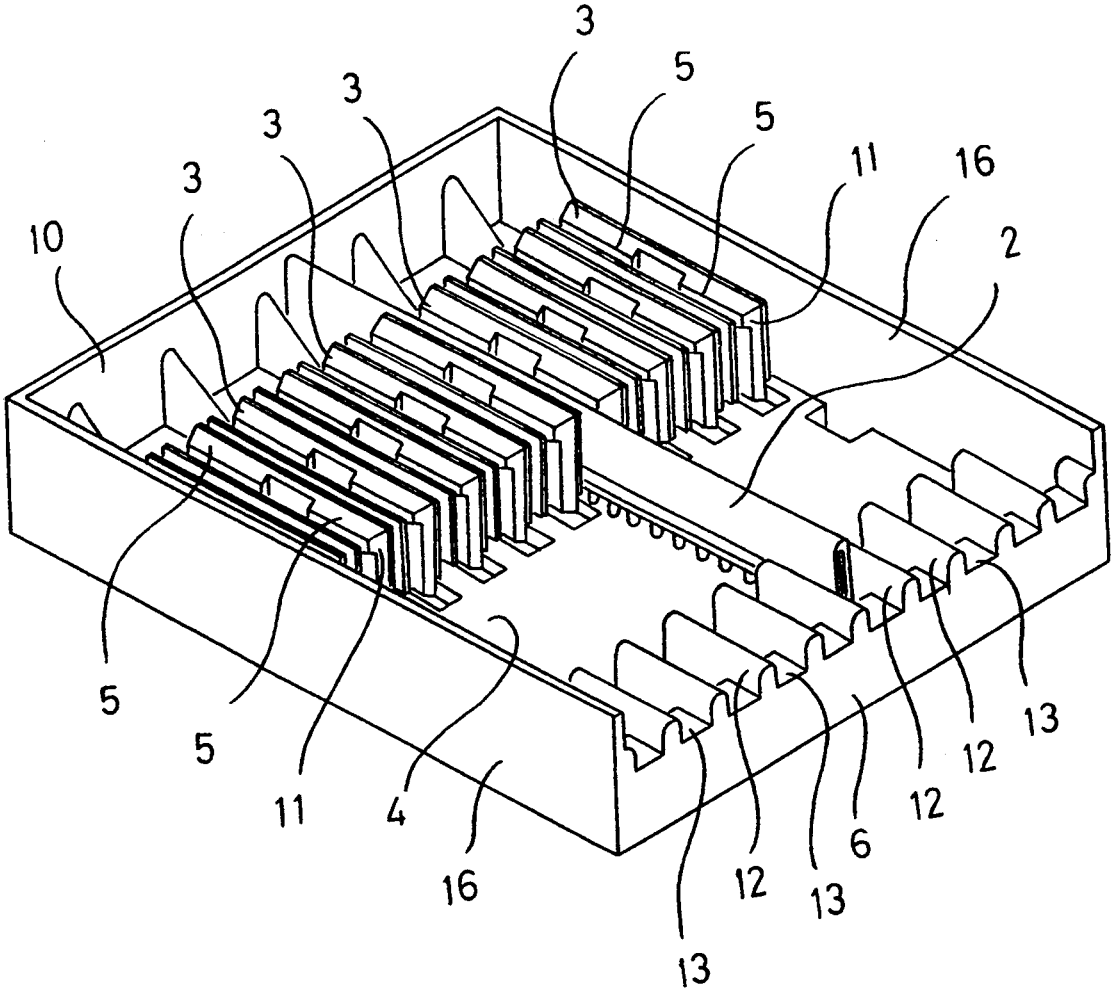
FIG. 1 is a perspective view of a spare blade storage case constructed in accordance with the invention.
Figure 2:
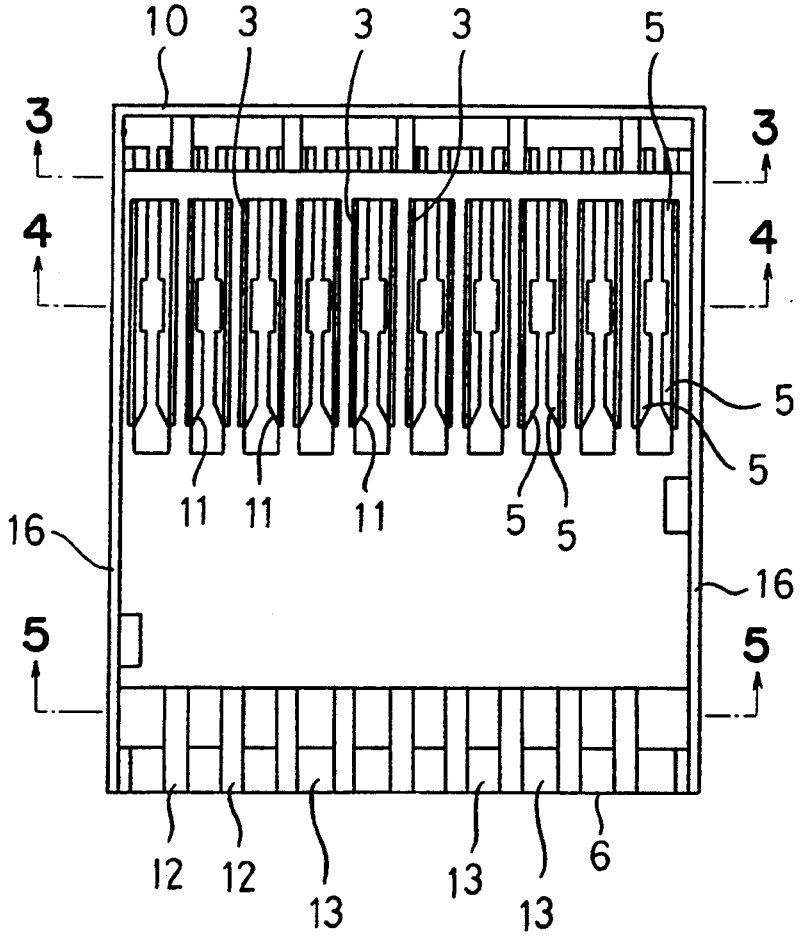
FIG. 2 is a plan view of the case.
Figure 3:
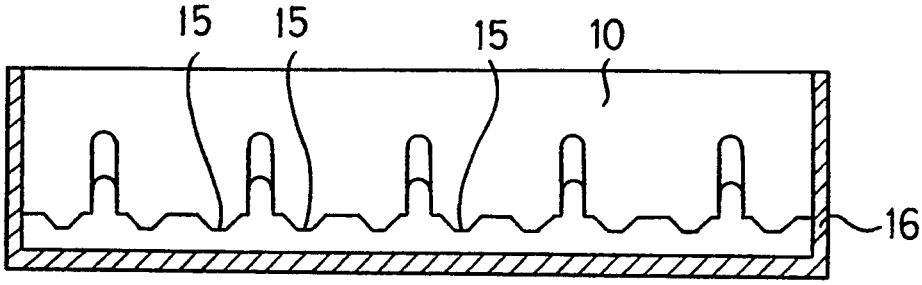
FIG. 3 is an enlarged sectional view as taken along a line 3—3 in FIG. 2.
Figure 4:
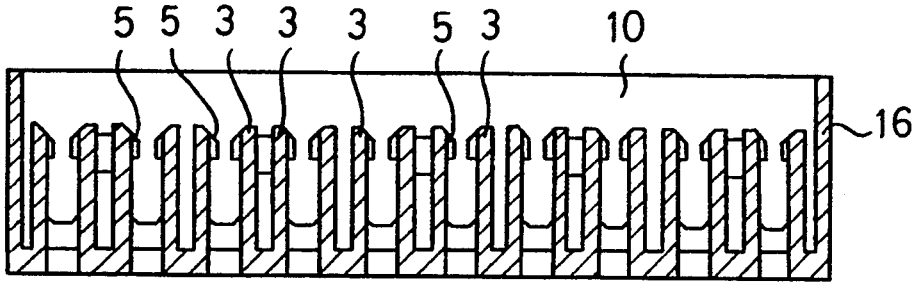
FIG. 4 is an enlarged sectional view as taken along a line 4—4 in FIG. 2.
Figure 5:
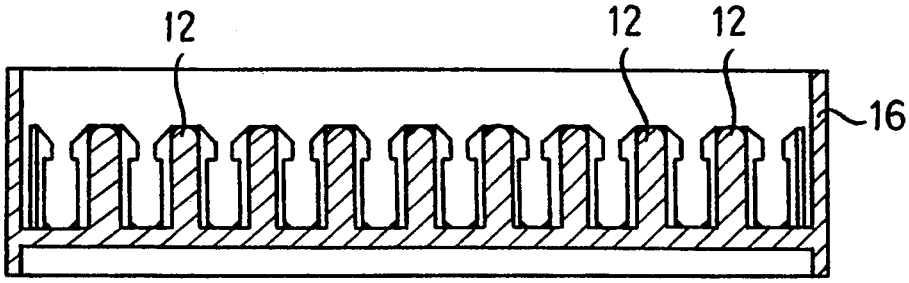
FIG. 5 is an enlarged sectional view as taken along a line 5—5 in FIG. 2.

A spare blade storage case (FIGS. 1–5) is integrally molded from suitable plastic material and has a rectangular shape as viewed from above. There are provided, within the case, ten spaces for storage of spare blades, and each space is laterally defined by a pair of adjacent sidewalls 3 extending upwardly from the bottom 4 of the case. Each sidewall 3 has a length which is approximately equal to $\frac{1}{3}$ of the case's length, and all sidewalls 3 are arranged and positioned adjacent a rear end wall 10. Each sidewall 3 has, adjacent its upper edge, a projection 5 integrally formed on the inner surface thereof, and the front upper end 11 of each projection 5 is chamfered so as to facilitate insertion of the blade holder 14 (FIGS. 9–11) into the storage space. The height of the front end wall 6 is dimensioned to be lower than that of the rear end wall 10, and there are provided nine spaced walls 12 each extending upwardly perpendicular to the front end wall 6 so as to define ten recesses 13 at regular intervals substantially over the entire width of the front end wall 6. Each recess 13 serves as a guide along which the forward end of the blade holder 14 is moved so as to be aligned with the spare blade 2 to be coupled to this blade holder 14, so that the spare blade 2 can be easily inserted into the blade holder 14. The bottom surface 4 of the case is formed, adjacent to rear end wall 10, with ten grooves 15 (FIG. 3) which contribute to stabilizing the stored spare blades 2 substantially in a vertical orientation. It should be understood that the spare blade storage case of the present invention is not limited to the specific embodiment as has been described hereinabove. For example, the number of the storage spaces may be one or many, as desired, so far as the number is practically reasonable. It is also possible to replace the outermost sidewalls by respective sidewalls 16 of the case.

Figure 9:
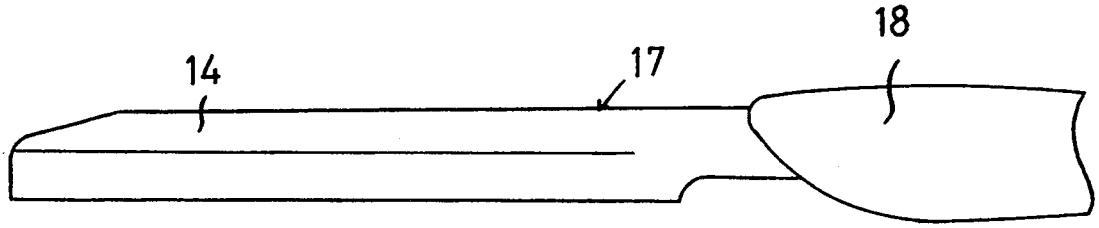
FIG. 9 is a fragmentary side view of an assembled razor.
Figure 10:
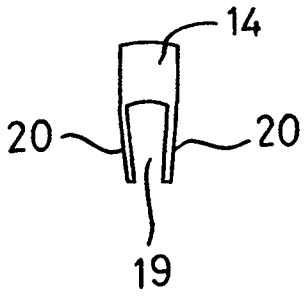
FIG. 10 is a frontal end view of a blade holder.

An example of a razor assembly 17 (FIG. 9), used in association with the storage case of the invention, is shown in FIGS. 9 and 10. As shown, the assembly 17 includes a relatively slender grip 18 fixedly connected to the rear end of a metallic blade holder 14 which has, in turn, a downwardly opened groove 19 extending substantially along its entire length so as to present, at the forward end of the blade holder 14, a cross-sectional configuration being downwardly tapered as shown in FIG. 10. The body of the blade holder 14 itself has a cross-sectional configuration similar to that of the end view of FIG. 10, i.e. it has a groove 19, and both side surfaces 20 thereof are inwardly inclined.

Figure 11:
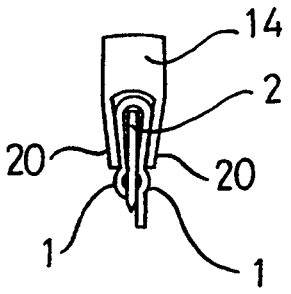
FIG. 11 is a frontal end view of a spare blade coupled to a blade holder.

FIG. 11 is a front view showing the spare blade 2 fixedly inserted into the blade holder 14. As will be apparent, the ridges 1 of the spare blade 2 are never engaged into the groove 19 of the blade holder 14 but are positioned closely adjacent the lower edges of the blade holder 14. Presence of these ridges 1 assures that shaved hairs are deflected away therealong and prevented from being caught between the spare blade 2 and each sidewall of the blade holder 14.

Figure 6:
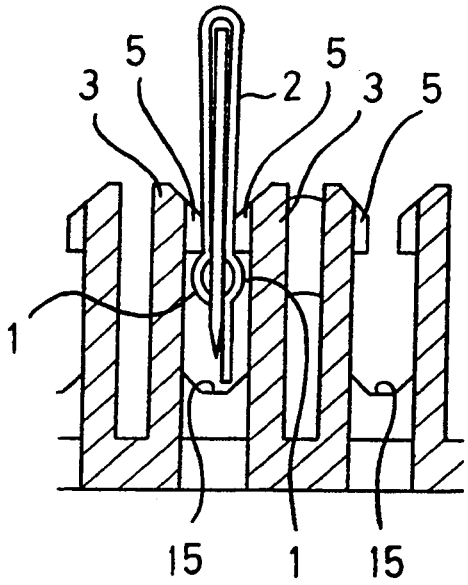
FIG. 6 is a diagram schematically showing a spare blade as held between opposite sidewalls.
Figure 7:
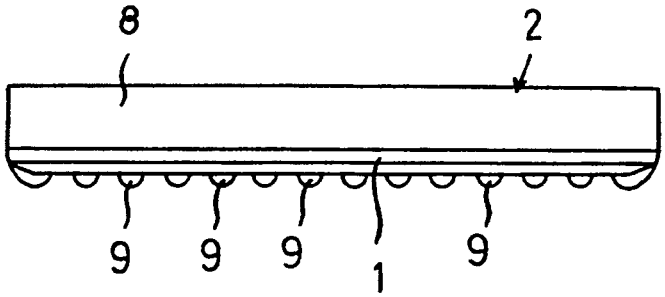
FIG. 7 is a side view of a spare blade.

FIG. 6 shows the spare blade 2 having been stored in the case. Specifically, the spare blade 2 is held between a pair of adjacent sidewalls 3 with the ridges 1 of the spare blade 2 being positioned just below the respective projections 5 of the sidewalls 3, so that the spare blade is normally prevented from slipping out from between the sidewalls 1. To mount the spare blade 2, stored in the case in this manner, in the blade holder 14, the front end of the blade holder 14 may be placed in the guiding recess 13 of the case to align the front open end of the groove 19, defined by the blade holder 14, with the rear end of the spare blade 2. Then, the blade holder 14 may be thrust forwardly to insert the spare blade 2 into the groove 19. The spare blade 2 is completely mounted in the blade holder 14 by fully thrusting the blade holder 14 into the case. As will be apparent from FIGS. 6 and 11, the projections 5 of the respective sidewalls 3 bear against the respective inclined side surfaces 20 of the blade holder 14 as the blade holder 14 is thrust into the space defined between said sidewalls 3, and the projections 5 press against the respective inclined side surfaces 20 due to the elasticity of said sidewalls 3. As a consequence, upward-directed pressure is exerted on the blade holder 14 and, therefore, the blade holder 14 is upwardly urged along the sidewalls 3 as the blade holder 14 is upwardly urged along the sidewalls 3 as the blade holder 14 is fully thrust into the case. To again store the used blade in the case, the used blade in the case, the blade holder 14, holding the spare blade 2, is pressed into the space between the sidewalls 3, and then the blade holder 14 is pulled toward the user, so that the rear end of the spare blade 2 may be locked on the front end wall 6 of the case and remain within the case.

Figure 12:
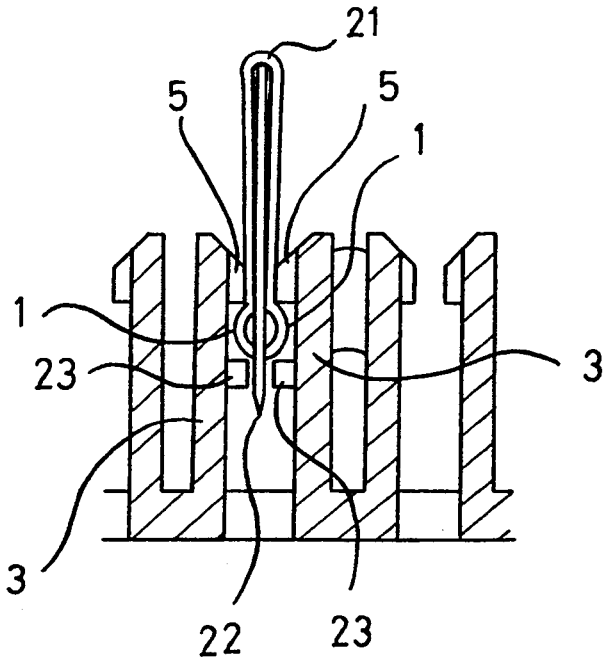
FIG. 12 is a diagram schematically showing a variant of the spare blade as held between opposite sidewalls.

FIG. 12 illustrates a variant of the spare blade 2 and a manner in which this spare blade 2 is stored in the case. This variant of the spare blade 2 cannot be supported directly on the bottom surface of the case because the backing strip 21 has no comb teeth and the shaving edge is exposed. To overcome such limitation, the inner surfaces of the respective paired sidewalls 3 are provided, in addition to and beneath the previously mentioned projections 5, second projections 23 so that these second projections 23 are engageable with the respective ridges 1 of the spare blade 2 and thereby hold the spare blade 2 above the bottom surface of the case.

With the arrangement of the invention as described above, the space assigned to receive each spare blade 2 is defined by a pair of the adjacent flexible sidewalls 3 which are, in turn, provided on the respective inner surfaces with the projections 5. Accordingly, once the spare blade 2 provided on the opposite side surfaces thereof with ridges 1 has been stored in the space, the projections 5 cooperate with the associated ridges 1 to keep the spare blade 2 against accidentally slipping out of the storage case. Flexibility of the sidewalls 3 effectively assists the above-mentioned function of projections 5, as well as of ridges 1 for reliably holding the spare blade 2 between the pair of sidewalls 3. Accordingly, the blade assembly can be taken out from the case, not by lifting up the rear end of the blade holder 14 and obliquely orienting the blade holder 14 as conventionally has been necessary, but by pulling the blade assembly as a whole directly upwardly. Consequently, the invention allows the spare blade 2 to be configured in a rectangular shape having four right angled corners and thereby solves the problem of prior art that the length of the blade holder 14 inconveniently exceeds the length of the shaving edge available for the spare blade.

What is claimed is:

1. A case for storing at least one spare blade of a type having a thin blade portion, a back support formed onto the thin blade portion, side plates for supporting the thin blade portion therebetween, and a pair of longitudinal protrusions formed on said side plates, said case having an interior bottom surface, a front end wall, and a rear end wall, said case further comprising:

a pair of parallel adjacent sidewalls extending upwardly from said interior bottom surface of said case, laterally defining therebetween a space for storage of a said spare blade, said sidewalls each having an inner facing surface;

a pair of projections provided on each of said inner facing surfaces of said pair of sidewalls, said sidewalls being yieldable away from a said spare blade as the spare blade is inserted into said space; and a plurality of spaced walls, each extending upwardly from said front end wall to define recesses therebetween serving as guides along which a blade holder may be thrust forwardly, whereby a spare blade held between the sidewalls may be easily inserted into the blade holder.

2. A case for storing at least one spare blade of a type having a thin blade portion, a back support formed onto the thin blade portion, side plates for supporting the thin blade portion therebetween, and a pair of longitudinal protrusions formed on said side plates, said case having an interior bottom surface, said case further comprising:

a pair of parallel adjacent sidewalls extending upwardly from said interior bottom surface of said case, laterally defining therebetween a space for storage of a said spare blade, said sidewalls forming mutually facing surfaces; and a first pair of projections provided on said facing surfaces of said pair of sidewalls, and a second pair of projections provided on said facing surfaces of said pair of sidewalls below said first pair of projections, said sidewalls being yieldable away from a said spare blade as the spare blade is inserted into said space, whereby an inserted spare blade is held between said sidewalls such that each said longitudinal protrusion of the inserted spare blade is captured between one of said first pair of projections and one of said second pair of projections.

* * * * *